US007756703B2

(12) United States Patent
Lee et al.

(10) Patent No.: US 7,756,703 B2
(45) Date of Patent: Jul. 13, 2010

(54) FORMANT TRACKING APPARATUS AND FORMANT TRACKING METHOD

(75) Inventors: Yongbeom Lee, Seoul (KR); Yuan Yuan Shi, Beijing (CN); Jaewon Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 730 days.

(21) Appl. No.: 11/247,219

(22) Filed: Oct. 12, 2005

(65) Prior Publication Data

US 2006/0111898 A1 May 25, 2006

(30) Foreign Application Priority Data

Nov. 24, 2004 (KR) ..... 10-2004-0097042

(51) Int. Cl.
*G10L 19/06* (2006.01)
*G10L 19/00* (2006.01)

(52) U.S. Cl. ..... 704/209; 704/219

(58) Field of Classification Search ..... 704/209, 704/219

See application file for complete search history.

(56) References Cited

U.S. PATENT DOCUMENTS

| | | | | |
|---|---|---|---|---|
| 4,424,415 | A * | 1/1984 | Lin | 704/209 |
| 4,882,758 | A * | 11/1989 | Uekawa et al. | 704/209 |
| 4,945,568 | A * | 7/1990 | Willems | 704/209 |
| 5,463,716 | A * | 10/1995 | Taguchi | 704/209 |
| 6,505,152 | B1 * | 1/2003 | Acero | 704/209 |
| 6,618,699 | B1 * | 9/2003 | Lee et al. | 704/209 |
| 2004/0199382 | A1 * | 10/2004 | Bazzi et al. | 704/209 |
| 2005/0049866 | A1 * | 3/2005 | Deng et al. | 704/240 |

OTHER PUBLICATIONS

McCandless, "An algorithm for automatic formant extraction using linear prediciton spectra", IEEE Trans. on Acoustic, Speech, and Signal Procesing, Apr. 1974.*

Welling et al. "Formant estimation for speech recognition", IEEE Trans. on Speech and Audio Processing, Jan. 1998.*

Snell et al. "Formant location from LPC analysis data", IEEE Trans. on Speech and Audio Processing, Apr. 1993.*

Kim et al. "Unsupervised statistical adaptive segmentation of brain MR images using the MDL principle", IEEE, Proc. of 20$^{th}$ annual International Conference of Engineering in Medicine and Biology Society, 1998.*

Svendsen et al. "On the automatic segmentation of speech signals", IEEE, ICASSP, 1987.*

* cited by examiner

*Primary Examiner*—Richemond Dorvil
*Assistant Examiner*—Jialong He
(74) *Attorney, Agent, or Firm*—Staas & Halsey LLP

(57) ABSTRACT

A formant tracking apparatus and a formant tracking method are provided. The formant tracking apparatus includes: a framing unit dividing an input voice signal into a plurality of frames; a linear prediction analyzing unit obtaining linear prediction coefficients for each frame; a segmentation unit segmenting each of the linear prediction coefficients into a plurality of segments; a formant candidate determining unit obtaining formant candidates by using the linear prediction coefficients, and summing the formant candidates for each segment to determine formant candidates for each segment; a formant number determining unit determining a number of tracking formants for each segment among the formant candidates satisfying a predetermined condition; and a tracking unit searching the tracking formants as many as the number of the tracking formants determined in the formant number determining unit among the formant candidates belonging to each segment.

18 Claims, 2 Drawing Sheets

FORMANT TRACKING APPARATUS AND FORMANT TRACKING METHOD

CROSS-REFERENCE TO RELATED APPLICATIONS

This application claims the benefit of Korean Patent Application No. 10-2004-0097042, filed on Nov. 24, 2004, in the Korean Intellectual Property Office, the disclosure of which is incorporated herein in its entirety by reference.

BACKGROUND OF THE INVENTION

1. Field of the Invention

The present invention relates to a formant tracking apparatus and method, and more particularly, to an apparatus and a method of tracking a formant for non-speech vocal sound signals as well as speech signals.

2. Description of the Related Art

A formant is a frequency at which a vocal tract resonance occurs.

The disclosed conventional formant tracking methods can be divided into three types of methods.

In a first method, the formant is located on a frequency representing a peak in a spectrum such as a linear prediction spectrum, a fast Fourier transform (FFT) spectrum, or a pitch synchronous FFT spectrum. The first method is simple and fast enough to be processed in real-time. In a second method, formants are determined by matching with reference formants. The matching usually used in speech recognition is to search the reference formants best matched with the formants to be determined. In a third method, accurate frequencies and bandwidths of formants are obtained by solving a linear prediction polynomial using linear prediction coefficients.

However, a problem of the aforementioned methods is that spectral peaks for defining formants are not always clearly exist in duration because the duration for an analysis is too short to be analyzed. Another problem is that a high pitched voice increases confusion between the pitch frequency and the formant frequency. In other words, since a high frequency produces a wider interval among harmonics in comparison with a spectral bandwidth of the formant resonance, the pitch or harmonics of the pitch may be erroneously regarded as a formant. In addition, analyzed sounds may induce complicated and additive resonances or anti-resonances.

SUMMARY OF THE INVENTION

Additional aspects and/or advantages of the invention will be set forth in part in the description which follows and, in part, will be apparent from the description, or may be learned by practice of the invention.

The present invention provides a formant tracking apparatus and method, in which linear prediction coefficients are obtained for a voice signal to be segmented into segments, formant candidates are determined for each segment, and formants are tracked by tracking formant candidates satisfying a predetermined condition.

According to an aspect of the present invention, there is provided a formant tracking apparatus, including: a framing unit dividing an input voice signal into a plurality of frames; a linear prediction analyzing unit obtaining linear prediction coefficients for each frame; a segmentation unit segmenting each of the linear prediction coefficients into a plurality of segments; a formant candidate determining unit obtaining formant candidates by using the linear prediction coefficients, and summing the formant candidates for each segment to determine formant candidates for each segment; a formant number determining unit determining a number of tracking formants for each segment among the formant candidates satisfying a predetermined condition; and a tracking unit searching the formants as many as the number of the tracking formants determined in the formant number determining unit among the formant candidates belonging to each segment.

According to another aspect of the present invention, there is provided a formant tracking method including: dividing an input voice signal into a plurality of frames; obtaining linear prediction coefficients for each frame and obtaining formant candidates by using the linear prediction coefficients; segmenting each of the linear prediction coefficients into a plurality of segments; summing the formant candidates for each segment to determine formant candidates for each segment; determining a number of tracking formants by using features of the formant candidates for each segment; and searching the tracking formants as many as the number of the tracking formants determined for each segment.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
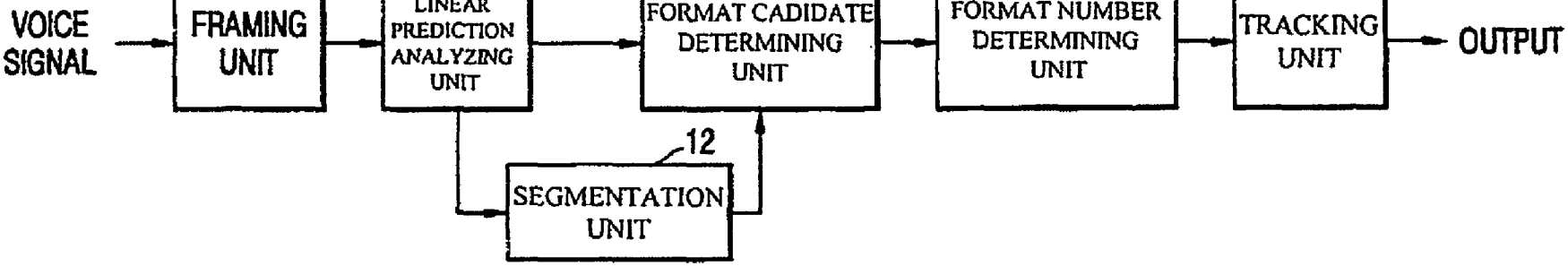
FIG. 1 is a block diagram illustrating a formant tracking apparatus according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

The present invention will now be described more fully, with reference to the accompanying drawings, in which exemplary embodiment of the present invention are shown.

Figure 2:
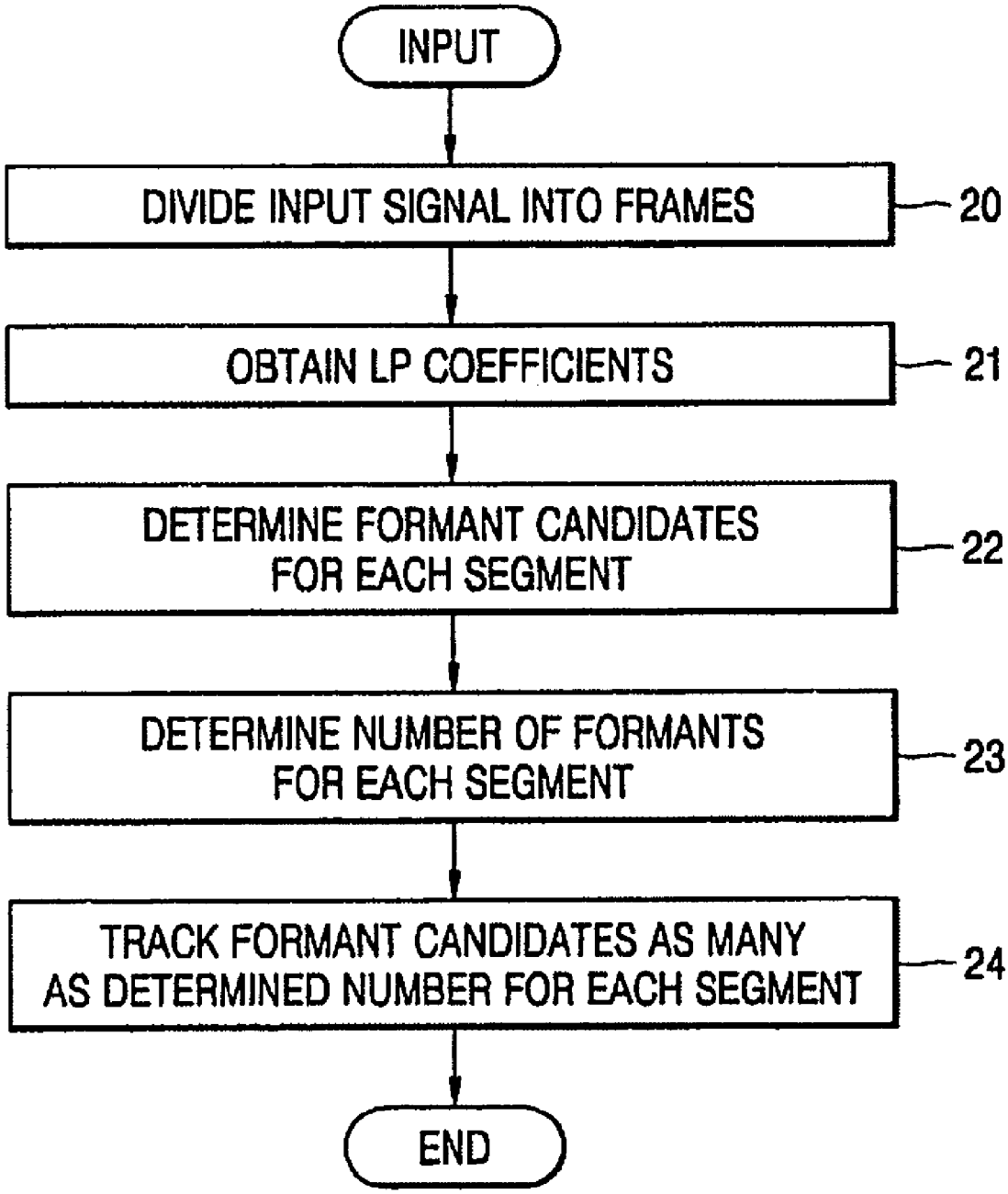
FIG. 2 is a flowchart illustrating a formant tracking method according to an embodiment of the present invention.

FIG. 1 is a block diagram illustrating a formant tracking apparatus according to an embodiment of the present invention, and FIG. 2 is a flowchart illustrating a formant tracking method according to an embodiment of the present invention.

Configuration and operations of the present embodiment will now be described with reference to FIGS. 1 and 2.

Referring to FIG. 1, a formant tracking apparatus includes a framing unit 10, a linear prediction (LP) analyzing unit 11, a segmentation unit 12, a formant candidate determining unit 13, formant number determining unit 14, and a tracking unit 15.

The framing unit 10 divides an input voice signal into a plurality of frames having an equal time length (operation 20). A window of the frame may have a size of 20, 25, or 30 ms, and a frame shift width of 10 ms. The frame window may be a hamming window, a square window, or the like. Preferably, the hamming window is adopted.

The linear prediction analyzing unit 11 produces a matrix by performing an autocorrelation for the frames output from the framing unit 10, and calculates linear prediction coefficients by applying a recursive method such as a Durbin algorithm to the matrix (operation 21). In the linear prediction method, the prediction is performed by linearly combining a voice signal at a predetermined time with a previous voice signal. The aforementioned methods used in the linear prediction are already known in the signal processing fields, and their detailed descriptions will not be provided here. In the present embodiment, an order of linear prediction coefficients is 14. The 14 order linear prediction coefficients mean that 7 formant candidates can be estimated for each frame. When more formant candidates are required, the larger than 14 order linear prediction coefficients should be used. However, in the present embodiment, the 14 order linear prediction coefficients or 7 formant candidates are sufficient even for a scream sound, which requires relatively many formant candidates.

The segmentation unit 12 segments the LP coefficients obtained in the LP analyzing unit 11 or an orthogonal transformation results of the LP coefficients into a plurality of segments. The segmentation is made by applying the following Equation 1 to $t_{th}$ frame of the $n^{th}$ segment in such a way that an objective function represented by a log-likelihood for a feature vector $x_i(i=\tau_1, \ldots, t)$ is maximized. Though the feature vector $x_i$ is the LP coefficient in the present embodiment, the present invention is not limited thereto. Using the LP coefficients as the feature vectors is advantageous in that the results of the LP analyzing unit 11 can be applied without any change or modification, so that any additional calculation is not necessary. The feature vectors for each segment can be modeled by a single Gaussian distribution:

$$\Phi(t, n) = \max_{t-l_{max} \le \tau \le t-l_{min}} [\Phi(\tau-1, n-1) + \log p(x_\tau, x_{\tau+1}, \cdots, x_t \mid u_{\tau\sim t}, E)] \quad (1)$$

where, $I_{min}$ denotes a minimum number of the frames of a segment, $I_{max}$ denotes a maximum number of the frames of a segment, $u_{\tau\text{-}t}$ denotes an average of the features in a segment from the frame $\tau$ to the frame t, and $\Sigma$ denotes a diagonal covariance of the features for the whole signal.

In addition, t denotes an end-point frame of the $n_{th}$ segment, $t\text{-}I_{max}$ denotes a frame locating $I_{max}$ frames before the frame t, and $t\text{-}I_{min}$ denotes a frame locating $I_{min}$ frames before the frame t.

In Equation 1, the objective function is set to maximize an accumulation of the log-likelihood function within a signal duration from the beginning of the n segments to the frame t. As a result, a feature distribution in a static segment can be modeled by a single Gaussian distribution. The number of segments and the length of each segment can recursively searched based on a dynamic programming for Equation 1 by applying the following objective function.

The initialization is performed by $\Phi(0,0)=0$.

Assuming the number of all frames for an input voice signal is T, in a case of one segment, the objective function of Equation 1 can be represented by $\Phi(1,1), \Phi(2,1), \ldots, \Phi(T-l_{min}-1,1), \Phi(T,1)$ for each frame.

In a case of n segments, the objective function of the $n_{th}$ segment is given by $\Phi(1+(n-1)(1+l_{min}),n), \ldots, \Phi(T-l_{min}-1, n), \Phi(T,n)$ with respect to frames from the beginning of the nth segment, $1+(n-1)(1+l_{min})$th frame, to the frame T. Therefore, n is within a range of $$1 \le n \le \left\lfloor \frac{T-1}{l_{min}+1} \right\rfloor.$$

The division based on the dynamic programming requires a criterion for terminating an unsupervised segmentation on the basis of the maximization of the segment likelihood in principle. If there is no criterion, a best division will be a single frame per a single segment. Therefore, according to the present embodiment, the number of segments can be obtained based on the following Equation 2 using a minimum description length (MDL) criterion;

$$N = \underset{n}{\operatorname{argmin}}\left\{-\Phi(T, n) + \frac{m(n)}{2}\log(T)\right\} m(n) = 2 \times Dim(x) \times n, \quad (2)$$

where, Dim(x) is a dimension of feature vectors.

According to an aspect of the present embodiment, a single Gaussian modeling of feature distribution is used in a single segment. Therefore, it is proper that m(n) is calculated as shown in Equation 2. If other modeling methods are used, the calculation of m(n) will be changed depending on a model structure on the basis of the MDL theory. The modeling methods include Akaike information criteria (AIC), Bayesian information criteria (BIC), low entropy criterion, etc. When the number N is obtained according to Equation 2, the input voice signal is divided into N segments.

The formant candidate determining unit 13 is to solve the LP polynomial obtained from the LP coefficients output from the LP analyzing unit 11. Since the solutions of the LP polynomial are obtained as complex conjugates, frequencies and bandwidths for the obtained solutions are calculated to output the formant candidates. Roots of the LP polynomial can be generally represented by $z=e^{(-\pi b+j2\pi f)}$, where b and f denote a formant bandwidth and frequency, respectively. More specifically, the roots of the LP polynomial represent a transfer function of a vocal tract of a speaker. Formants can be found by picking peak positions in a spectrum under an assumption that the formants nearly match with peak frequencies of a vocal tract spectrum. As described above, according to the present embodiment, it is possible to obtain 7 complex conjugates roots from the 14 order LP coefficients, and thus, 7 formant candidates are obtained. The obtained formant candidates exist per each frame.

Then, the formant candidates obtained for each frame are summed for each segment based on the number and the length of the segment input from the segmentation unit 12, and the formant candidates for each segment are determined (operation 22).

The formant number determining unit 14 determines the number of formants, $N_{fm}$, to be tracked based on the following Equation 3 among the formant candidates for each segment determined in the formant candidate determining unit 13.

$$N_{fm} = \frac{\sum_{t=1\sim T} num(f(t, i), b(t, i) < TH)}{T}, \quad (3)$$

where, f(t, i) denotes a formant frequency of a frame t, b(t,i) denotes an ith formant bandwidth of frame t, num(f(t,i),b(t,i) <TH) denotes the number of formants of which bandwidths are narrower than a threshold value TH, e.g., 600 Hz.

In Equation 3, the number of formants to be tracked in a frame is determined as an average number of the formants having bandwidths narrower than the threshold value TH. Therefore, the number of tracking formants for each segment becomes a sum of the number of the tracking formants for the frames in a corresponding segment, and the number of the tracking formants varies for each segment, accordingly.

Such determination is very effective in that the resultant number of the tracking formants calculated by Equation 3 is the same with that obtained by manually inspecting a graph of the formant track.

The tracking unit 15 tracks according to a dynamic programming algorithm to select the formants as many as determined in the formant number determining unit 14 for each segment among the formant candidates belonging to the corresponding segment (operation 24).

An objective function used herein for applying the dynamic programming algorithm is similar to that used in segmentation unit 12.

$$\Phi(t, j) = \max_i \lfloor \Phi(t-1, i) + \log p(x_j \mid u, E) \rfloor, \quad (4)$$

where, j denotes a set of formants determined for a frame t based on Equation 3, and i denotes an order of a set of formants.

The feature vector y includes a selection frequency, a delta frequency, a bandwidth, and a delta bandwidth of the selected formant. Therefore, the dimension of the feature vector is represented by 4*S. Each delta value represents a difference between the previous frame and the current frame.

A feature distribution can be modeled by a single Gaussian distribution for each segment. First, an average and a diagonal covariance of the feature distribution are initialized. In the present embodiment, initialization values other than an average frequency for S formant tracks are:

standard deviation of frequencies: 500 Hz, average of bandwidths: 100 Hz, standard deviation of bandwidths: 100 Hz, average of delta frequency: 0 Hz, standard deviation of delta frequencies: 100 Hz, average of delta bandwidths: 0 Hz, and standard deviation of delta frequencies: 100 Hz.

The above initialization values may be differently set and they would not significantly influence on formant tracking performance.

However, the initialization value of an average of the S formant tracks is calculated in a different manner. First, the entire frequency bandwidth of the signals is divided in 500 Hz unit. For example, if a sampling rate is 16,000 Hz, a bandwidth is divided into 80/5, i.e., 16 bins, so that each bin has a bandwidth of 500 Hz. In this case, the bandwidth of 500 Hz would be a sufficient value for an initialization interval between center frequencies of two formant tracks.

A histogram of the formant candidates for each segment is counted into 16 bins, respectively under a constraint on bandwidths of the formant candidates. In other words, only the formant frequencies having a bandwidth narrower than a threshold value, i.e., 600 Hz, are counted as being included in a corresponding bin. In this case, the threshold value refers to a threshold bandwidth used to determine the number of the formant tracks in the formant number determining unit 14. Limiting the formant candidates to those counted in the histogram bin using the threshold value is to reduce influences of the candidates having a broader bandwidth. The number of the candidates having a broader bandwidth is relatively larger than the number of the candidates having a narrower bandwidth. Nevertheless, the frequencies having the narrower bandwidth become desired formants. Therefore, the candidates having the broader bandwidth should be excluded.

As described above, S bins are selected from the candidates having a maximum count number, and an average of the formant frequencies of the selected S bins is initialized to the average of the S formant frequencies. Briefly to say, the average of the formant frequencies of S formant tracks is initialized by counting a frequency distribution in the histogram. The reason for such initialization is as follows. The formant tracking in each segment is usually performed with an insufficient number of data. Therefore, in comparison with a condition that sufficient data are provided, the initialization value of the average of formant track frequencies would influence on a final convergent solutions. In other words, most of the resultant stable frequency tracks are smooth tracks nearly close to the initialization values. Therefore, the average of the tracks is initialized to the average of the tracks having the narrower bandwidths. Experimentally, the initialization described above yields better performance than a case that the average of the formant frequencies is randomly or fixedly initialized. This is why the non-voiced formants have different features from the voiced formants, and the initialization according to an aspect of the present invention is robust for the formants of a variety of frequency ranges. Gaussian parameters, i.e., an average and a covariance are updated whenever a tracking according to a single dynamic programming is completed after the initialization.

In summery, first, Gaussian parameters are initialized, and a dynamic programming tracking is performed on the basis of a log-likelihood, so that S formants are selected from the formants for the frames belonging to each segment. Then, the Gaussian parameters, i.e., an average and a covariance of the feature vectors are updated based on the selected formant track data. The tracking and the estimation are repeated until the formant tracking is converged and stabilized.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

According to the present invention, it is possible to provide a fast and robust formant tracking method in a variety of frequency ranges by dividing the LP coefficients into a plurality of segments, determining the number of formants for each segment, and tracking a portion of the formants selected from those of the frames belonging to each segment.

While the present invention has been particularly shown and described with reference to exemplary embodiments thereof, it will be understood by those of ordinary skill in the art that various changes in form and details may be made therein without departing from the spirit and scope of the present invention as defined by the following claims.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A formant tracking apparatus, comprising:

a framing unit dividing an input voice signal into a plurality of frames;

a linear prediction analyzing unit obtaining linear prediction coefficients for each of the frames;

a segmentation unit grouping the linear prediction coefficients for the frames into a plurality of segments;

a formant candidate determining unit obtaining formant candidates by using the linear prediction coefficients, and summing the formant candidates for the frames, for each segment to determine formant candidates for each segment;

a formant number determining unit determining a number of tracking formants for each segment among the formant candidates satisfying a predetermined condition; and a tracking unit searching the formants, a number of the formants searched being as many as the number of the tracking formants determined in the formant number determining unit among the formant candidates belonging to each segment, wherein the number of the tracking formants is determined by averaging over all of the frames a number of the formants having bandwidths which are narrower than a predetermined value among the formant candidates.

2. The formant tracking apparatus as claimed in claim 1, wherein each of the plurality of frames has a frame window of which size is any one of 20, 25, or 30 ms.

3. The formant tracking apparatus as claimed in claim 2, wherein the frame window has a frame shift width of 10 ms.

4. The formant tracking apparatus as claimed in claim 1, wherein the linear prediction coefficients are obtained by applying a recursive method.

5. The formant tracking apparatus as claimed in claim 4, wherein the recursive method is a Durbin algorithm.

6. The formant tracking apparatus as claimed in claim 1, wherein the segmentation unit determines a number n of segments and duration for each segment, which maximizes an objective function represented by a distribution function of the linear prediction coefficients belonging to predetermined frames.

7. The formant tracking apparatus as claimed in claim 6, wherein the number n of the segments is determined within a range of, $$1 \le n \le \left\lfloor \frac{T-1}{l_{min}+1} \right\rfloor$$

where, T denotes a number of all frames, and $I_{min}$ denotes a minimum number of frames in a segment.

8. The formant tracking apparatus as claimed in claim 6, wherein the number of the segments is represented by N and determined by solving Equation:

$$N = \underset{n}{\operatorname{argmin}}\left\{-\Phi(T, n) + \frac{m(n)}{2}\log(T)\right\} m(n) = 2 \times Dim(x) \times n,$$

where, Dim(x) denotes a dimension of feature vectors, T denotes a number of all frames based on the input voice signal, and $\Phi(T, n)$ denotes an objective function of a Tth frame in an nth segment.

9. The formant tracking apparatus as claimed in claim 1, wherein the tracking unit searches a set of formants maximizing an objective function, the objective function represented by a distribution function for feature vectors of the formants, the set of formants including as many as the number of the tracking formants among the formant candidates belonging to each segment.

10. A formant tracking method comprising:

dividing an input voice signal into a plurality of frames;

obtaining linear prediction coefficients for each of the frames and obtaining formant candidates by using the linear prediction coefficients;

grouping the linear prediction coefficients for the frames into a plurality of segments;

summing the formant candidates for the frames, for each segment to determine formant candidates for each segment;

determining a number of tracking formants by using features of the formant candidates for each segment; and searching the tracking formants, the searching being upon as many as the number of the tracking formants determined for each segment, wherein the number of the tracking formants is determined by averaging over all of the frames a number of the formants having bandwidths which are narrower than a predetermined value among the formant candidates.

11. The formant tracking method as claimed in claim 10, wherein the segmentation of the linear prediction coefficients includes determining a number n of segments and durations of each segment, which maximizes an objective function represented by a distribution function of the linear prediction coefficients belonging to predetermined frames.

12. The formant tracking method as claimed in claim 11, wherein the predetermined frames are within a range of $$t - l_{max} \le \tau \le t - l_{min},$$

where, t denotes a current frame, $I_{max}$ denotes a maximum number of the frames in a segment, $\tau$ denotes the predetermined frames, and $I_{min}$ denotes a minimum number of the frames in a segment.

13. The formant tracking method as claimed in claim 11, wherein the distribution function is a Gaussian distribution function of the linear prediction coefficients, the Gaussian distribution function being based on a calculated average of the linear prediction coefficients within a range from a frame $\tau$ to a frame t, and a variance, given by a covariance of the linear prediction coefficients of the whole frame.

14. The formant tracking method as claimed in claim 13, wherein the number n of the segments is determined within a range of $$1 \le n \le \left\lfloor \frac{T-1}{l_{min}+1} \right\rfloor,$$

where T denotes a number of all frames of the input voice signal.

15. The formant tracking method as claimed in claim 11, wherein the number of the segments is represented by N, and obtained by solving Equation $$N = \underset{n}{\operatorname{argmin}}\left\{-\Phi(T, n) + \frac{m(n)}{2}\log(T)\right\} m(n) = 2 \times Dim(x) \times n,$$

where, Dim(x) denotes a dimension of the feature vectors, T denotes a number of all frames for the input voice signal, and Φ(T, n) denotes an objective function for a $T_{th}$ frame of an $n_{th}$ segment.

16. The formant tracking method as claimed in claim 10, wherein the searching the tracking formants includes searching a set of formants maximizing an objective function, the objection function represented by a distribution function of feature vectors of the formants, the set of formants including as many as the number of the tracking formants among the formant candidates belonging to each segment.

17. The formant tracking method as claimed in claim 16, wherein the feature vectors of the formants include selection frequencies of the selected formants, delta frequencies representing differences of formant frequencies between a current frame and a previous frame, bandwidths and delta bandwidths representing differences of bandwidths between a current frame and a previous frame.

18. A computer readable recording medium storing a program capable of executing a formant tracking method comprising:

dividing an input voice signal into a plurality of frames;

obtaining linear prediction coefficients for each of the frames and obtaining formant candidates by using the linear prediction coefficients;

grouping the linear prediction coefficients for the frames into a plurality of segments;

summing the formant candidates for the frames, for each segment to determine formant candidates for each segment;

determining a number of tracking formants by using features of the formant candidates for each segment; and searching the tracking formants, the searching being upon as many as the number of the tracking formants determined for each segment, wherein the number of the tracking formants is determined by averaging over all of the frames a number of the formants having bandwidths which are narrower than a predetermined value among the formant candidates.

* * * * *

UNITED STATES PATENT AND TRADEMARK OFFICE

CERTIFICATE OF CORRECTION

PATENT NO. : 7,756,703 B2
APPLICATION NO. : 11/247219
DATED : July 13, 2010
INVENTOR(S) : Yongbeom Lee et al.

It is certified that error appears in the above-identified patent and that said Letters Patent is hereby corrected as shown below:

First Page Column 2, Line 2 delete "prediciton" and insert --prediction--, therefor.

First Page Column 2, Line 3 delete "Procesing" and insert --Processing,--, therefor.

Column 8, Line 50 in Claim 13, delete "11," and insert --12,--, therefor.

Signed and Sealed this
Fifth Day of June, 2012

David J. Kappos

David J. Kappos
*Director of the United States Patent and Trademark Office*